US005446253A

United States Patent [19]

Oshgan

[11] Patent Number: 5,446,253

[45] Date of Patent: Aug. 29, 1995

[54] SWITCH ACTUATOR ASSEMBLY

[75] Inventor: Thomas J. Oshgan, Mt. Prospect, Ill.

[73] Assignee: Eaton Corporation, Cleveland, Ohio

[21] Appl. No.: 230,671

[22] Filed: Apr. 21, 1994

[51] Int. Cl.[6] ..... H01H 3/20

[52] U.S. Cl. ..... 200/556; 200/553; 200/557; 200/6 R

[58] Field of Search ..... 200/556, 553, 557, 558, 200/559, 6 RX, 6 C, 16 R, 16 C, 16 D,

[56] References Cited

U.S. PATENT DOCUMENTS

| | | | |
|---|---|---|---|
| 2,972,663 | 2/1961 | Zanichkowsky | 200/557 |
| 3,454,735 | 11/1967 | Wilde | 200/556 |
| 3,571,545 | 3/1971 | Haderer | 200/557 |
| 3,852,552 | 12/1974 | Kimijima et al. | 200/557 |

*Primary Examiner*—Henry J. Recla
*Assistant Examiner*—David J. Walczak
*Attorney, Agent, or Firm*—Roger A. Johnston

[57] ABSTRACT

A rocker type switch actuator for sequentially actuating plural switches upon rotation in either of opposite directions from a neutral position. The actuator has a spring-loaded plunger which engages a recess in the housing. The recess has a central depression for neutral position detention and steep ramps disposed spaced on either side of the neutral recess. The steep ramps provide first actuation position detent action against the plunger upon user movement of the rocker from the neutral position. The steep ramp requires a substantially/increased user applied actuation force to move the plunger beyond the initial actuation position; and, upon the plunger cresting the top of the steep ramp a sudden decrease in user applied force is tactilely discernible to provide an indication that the second switching position has been reached.

6 Claims, 2 Drawing Sheets

SWITCH ACTUATOR ASSEMBLY

CROSS-REFERENCE TO RELATED APPLICATION

This application is related to the subject matter of application Ser. No. 106,005 filed Aug. 13, 1993 in the name of Thomas J. Oshgan entitled "DETENTED PADDLE BLADE SWITCH ASSEMBLY" and assigned to the assignee of the present invention.

BACKGROUND OF THE INVENTION

The present invention relates to actuators of the type pivotally moveable for sequentially actuating a plurality of switches. Actuators of this type are typically referred to as rocker or paddle-type actuators and are often employed for bi-directional pivotal movement in switches employed for remote control of servo motors. Typically, a rocker or paddle-type actuator is user rotatable in one direction from a neutral position for energizing a servo motor for operation in one direction or sense; and, the rocker or paddle-type actuator is user rotatable in the opposite direction from the neutral position for effecting operating of the servo motor in the opposite sense or direction.

However, it has been desired in some applications to provide for sequential operation of plural servo motors by continued rotation of the rocker or paddle-type actuator in one direction from the neutral position. Examples of this type of remote control servo actuation are found in automotive accessory control for operation of an automotive door power window motor. In such an application, a first mode of operation is energized upon initial movement of the rocker or actuator in one direction to a first position; and, upon continued movement of the rocker actuator in the same direction a second mode of window operation is provided at a second position. Heretofore, this dual mode-type of automotive power window motor control has been desired for providing intermittent energization of the power window lift motor in the initial or first position so long as the user maintains the switch in the position. Upon continued movement of the switch actuator to a second position, circuitry is enabled for effecting continuous operation of the servo motor despite user relaxation of the actuating force on the rocker actuator and return of the actuator to the neutral position.

Heretofore, the neutral position of the actuator has been detented by a resiliently biased plunger engaging a recess in the housing in order to provide a tactilely discernible increase in force required by the user to move the actuator from the neutral position in either direction to a first actuating position. However, in the known prior art, any additional increases in the force required to continue movement of the actuator in the same direction beyond the first or initial actuating position have been caused by the inherent forces in the switching mechanism to cause movement of the blades of the switch to be actuated. The limit of the actuator movement has been typically determined by the build up of forces in the switching mechanism due to overtravel of the initially actuated switch and the subsequently actuated switch with no clear tactilely discernible indication of the subsequent actuation.

It has however long been desired to provide a switch actuator which is capable of effecting sequential actuation of plural switches upon continued movement in a common direction and to provide for positive detenting of the subsequent switch actuating positions after the initial actuation.

SUMMARY OF THE INVENTION

The present invention provides a rocker or paddle type switch actuator pivotally mounted on a housing for bi-directional actuation in opposite directions from a neutral position. The actuator has a spring loaded plunger biased outwardly from the pivot which engages a detent recess provided in the housing upon which the actuator is mounted. The actuator may be used actuating a plurality of switches. The detent recess in the housing has an initial ramp or slope adjacent the neutral position and a steeper slope or ramp remote or distal the neutral position. Upon user application of force to the rocker or paddle actuator, the plunger is caused to be depressed to ramp up the first surface in the detent recess with a subsequent decrease in the force required for movement which decrease is tactilely discernible to the user. Upon user continued rotation of the actuator in the same direction, the plunger is caused to encounter a second steeper ramp in the recess which requires the user to apply a significantly increased force to continue movement of the actuator; and, upon the plunger reaching the summit of the ramp, a sudden decrease in the force required is tactilely discernible as an indication that the actuator has reached its second actuation position.

DETAILED DESCRIPTION

Figure 1:
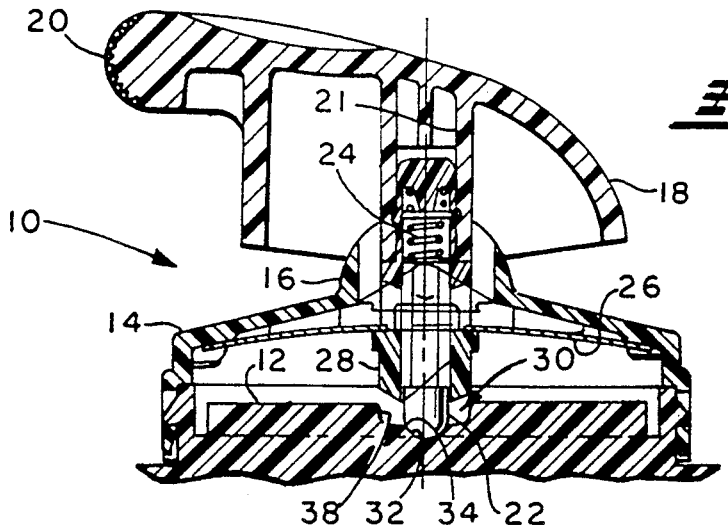
FIG. 1 is a cross-section of the actuator of the present invention shown in the neutral position.

Referring to FIG. 1, the actuator assembly of the present invention is indicated generally at 10 and includes a housing means comprising a base 12 and cover 14 received thereover and securely attached thereto as, for example, by snap lock connection. The cover 14 has a tower portion 16 upon which is pivotally mounted a rocker actuator 18 which has a user contact portion 20 or knob provided thereon for user application of force to the rocker to effect movement thereof.

The actuator member 18 has a guide recess 21 formed therein into which is slidably received a plunger member 22 which is biased downwardly and away from the pivot mount of the rocker by a suitable spring 24.

A beam spring 26 is disposed on the under surface of the cover 14 and has a central aperture therein with the guide portion 28 of the actuator extending downwardly therethrough for a guiding plunger 22. The base 12 has a recess indicated generally at 30 formed therein with a central neutral position depression 32 which generally conforms to the tip of plunger 22 such that the edges of the depression 32 denoted by reference numeral 34 provide a ramp or incline with the plunger biased downwardly into the depression 32.

Figure 2:
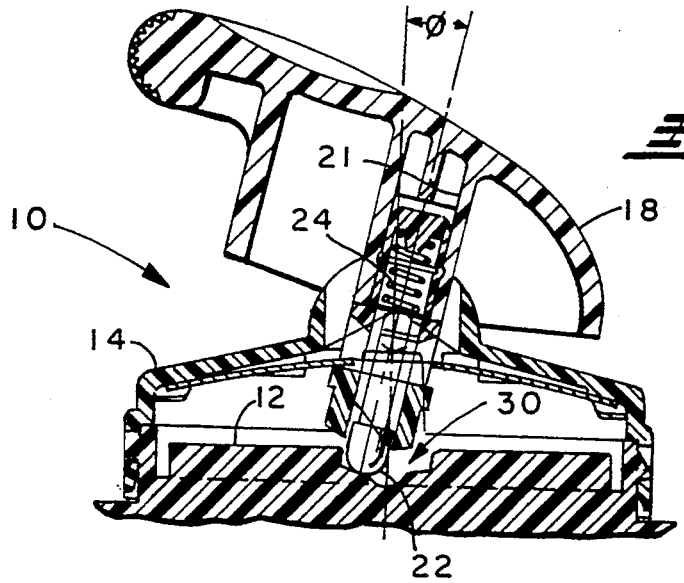
FIG. 2 is a view similar to FIG. 1 showing the actuator rotated in a clockwise direction from the neutral position to an initial actuating position.

Referring to FIG. 2, the actuator 18 is shown as rotated in the clockwise direction by an initial angular amount denoted by the reference character $\theta$ whereupon the end of plunger 22 has been forced to climb over edge 34 of the neutral depression 32 and the plunger is shown as registered against a notch formed by the second ramp comprising the vertically rising sidewall 36 of the recess 30. It will be understood that as the plunger 22 passes over the edge 34 of the neutral depression, the user is able to tactilely discern the sudden decrease in the force from that required to move the plunger upward against spring 24 to permit movement of the plunger out of the neutral position depression 32.

Figure 3:
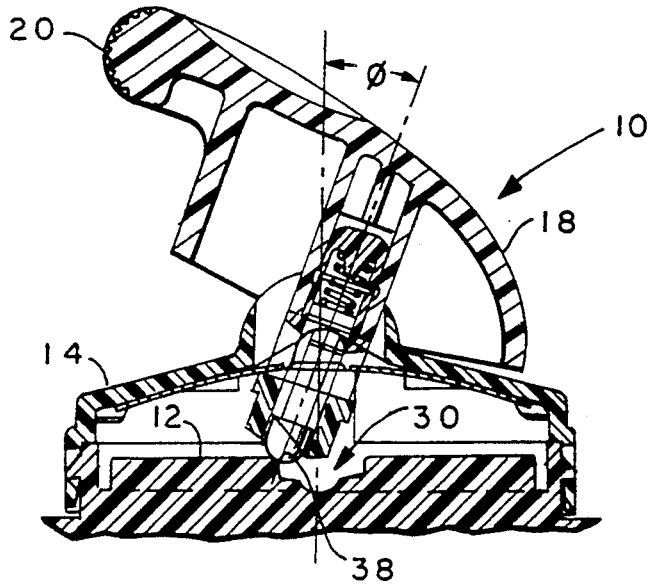
FIG. 3 is a view similar to FIG. 1 showing the rocker rotated an additional amount from the position of FIG. 2 to a second actuation position.

Referring to FIG. 3, the rocker is illustrated as rotated an additional amount in a clockwise direction from the position shown in FIG. 2 to an annular position indicated by reference character $\phi$ wherein the user has applied sufficient force to the tab 20 to cause the actuator to ramp the end of plunger 22 upwardly and over the edge 38 of the ramp 36. It will be understood that the near vertical orientation of the wall or ramp 36 serves as a second detent for plunger 22 in the initially actuated position. The movement of the plunger over the shoulder or upper corner 38 of the wall 36 creates a tactilely discernible sudden decrease in the force required to move the actuator and upon the plunger moving over corner 38, the limit stop of actuator travel, shown in FIG. 3 is reached as the actuator closes against the top surface of cover 14 and provides the natural stop or detent for the second position of the actuator. In the presently preferred practice the value of the angle $\theta$ is about 11° degrees and the angle $\phi$ for the second actuation is about 20°.

Figure 4:
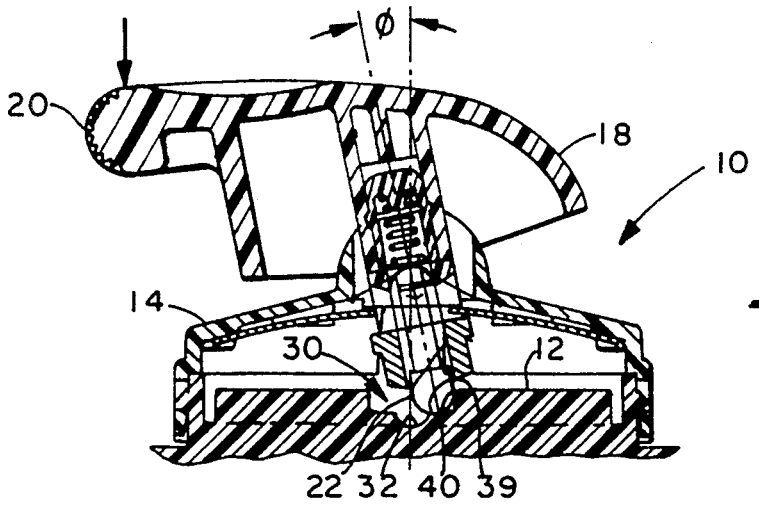
FIG. 4 is a view similar to FIG. 1 showing the actuator rotated in a counterclockwise direction from the neutral position to an initial actuating position.

Referring to FIG. 4, the actuator 18 is illustrated as rotated in a counterclockwise direction from the neutral position by an angular displacement of $\theta$. In the position illustrated in FIG. 4 the plunger 22 has ramped up over the edge 39 of the neutral recess 32 and is detented against the steep wall of the second ramp 40 to provide the user with a tactilely discernible indication of the initially actuated position in a direction opposite that of the actuator movement of FIG. 2.

Figure 5:
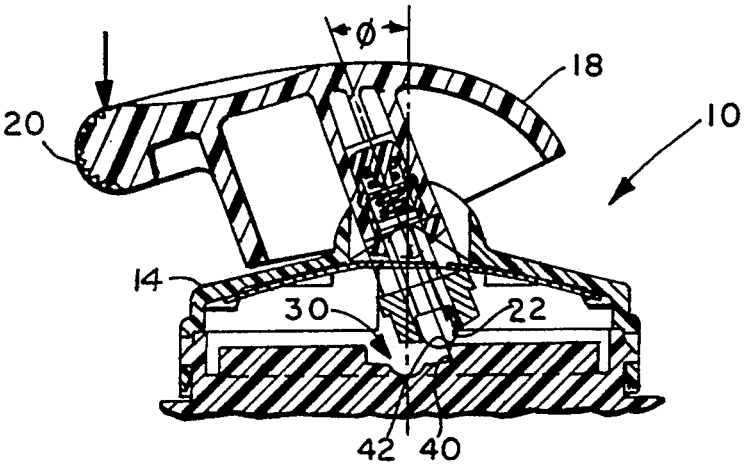
FIG. 5 is a view similar to FIG. 1 showing the rocker actuator moved an additional amount from the position shown in FIG. 4 to a subsequent actuating position.

Referring to FIG. 5, the actuator 18 has been rotated further in the counterclockwise direction from the position shown in FIG. 4 to a second detented position indicated by the angle $\phi$. In the position shown in FIG. 5, the plunger 22 has been forced to climb the steep ramp or wall 40 and to go over the shoulder or corner 42 thereof with a consequent tactilely discernible decrease in the amount of force required by the user at the point where the rocker 18 reaches its limit of travel against the upper surface of the cover 14.

Figure 6:
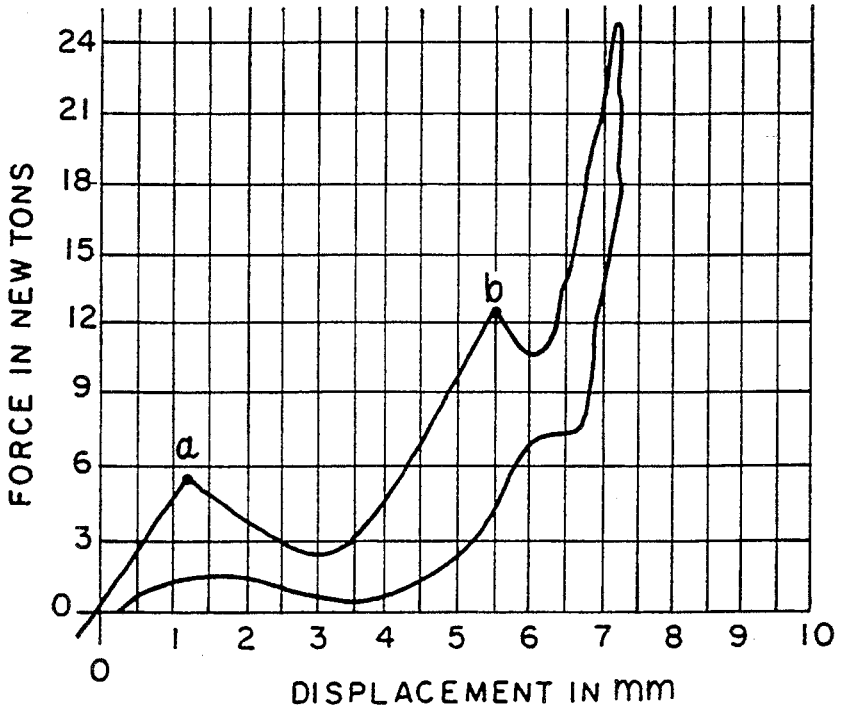
FIG. 6 is graphical plot of the actuator force as a function of displacement with the first and second detents denoted thereon by the points a and b.

Referring to FIGS. 4, 5 and 6, the force applied by the user on the knob 20 in the vertical direction as indicated by the black arrow in FIGS. 4 and 5.

Referring to FIG. 6, the force in Newton's is plotted as a function of the downward displacement in millimeters of the knob 20. The points denoted by the referenced characters a and b in FIG. 6 represent the detented positions indicated respectively by the angular displacements $\theta$ and $\phi$ and correspond to a value of $\theta=11.9°$ and $\phi=18°$. From the plot of FIG. 6 it will be seen that switch provides a positive and tactilely discernible detenting of the switch actuation in plural positions for sequentially actuating switches; and, such detenting is provided irrespective of the actuation characteristics of the switches to be actuated by the rocker 18.

The present invention thus provides a novel switch actuator capable of sequentially actuating a plurality of switches by rotation or movement in one direction and provides a tactilely discernible positive detenting of such plural actuation positions.

Although the invention has hereinabove been described with respect to the illustrated embodiments, it will be understood that the invention is capable of modification and variation and is limited only by the following claims.

We claim:

1. An electrical switch actuator assembly adapted for actuating plural switches comprising:

(a) housing means;

(b) an actuator member mounted for movement in opposite directions about a pivot on said housing means, said actuator member including plunger means defining a resiliently deflectable surface;

(c) detent means on said housing means, said detent means contacted by said plunger means deflectable surface and detenting a neutral position for said actuator, said detent means in co-operation with said plunger means operative to bias said actuator to a neutral position and provide a first predetermined resistance to user movement of said actuator member in one direction, away from said neutral position, to a first position and upon continued user movement in said one direction, said detent means operative in co-operation with said plunger to provide a second predetermined resistance substantially greater than said first resistance for user movement of said actuator member to a second position.

2. The actuator assembly defined in claim 1, wherein said plunger means slidably mounted on said actuator member and spring loaded outwardly from said pivot.

3. The actuator assembly defined in claim 1, wherein said detent means comprises a recess having a central depression defining said neutral position and a pair of sharply rising sides spaced on opposite sides of said neutral position for providing said greater resistance to movement of said actuator to said second position.

4. The actuator assembly defined in claim 1, wherein said detent means includes a surface defining a first ramp between said neutral position and said first position and a second ramp between said first and second positions, said second ramp having substantially greater slope than first said ramp.

5. A method of providing tactilely discernible positions indication of an actuator comprising:

(a) providing a housing and pivoting an actuator member thereon;

(b) resiliently biasing a portion of the actuator in contact with the housing;

(c) detenting the housing with a neutral position and a first ramp adjacent the neutral position and a second ramp steeper than said first ramp distal the neutral position and biasing said actuator to the neutral position;

(d) applying a first force on said actuator and moving said actuator in one direction, and ramping said biased portion from said neutral position to said first position; and, (e) applying a second force tactilely discernible greater than said first force on said actuator and moving said actuator in said one direction and ramping said biased portion from said first to said second position.

6. The method defined in claim 5, wherein said step of resiliently biasing includes providing a plunger slidable on said actuator portion and spring loading said plunger.

* * * * *